US007413488B2

(12) United States Patent
Matsumura

(10) Patent No.: US 7,413,488 B2
(45) Date of Patent: Aug. 19, 2008

(54) WIRE END TERMINAL AND METHOD OF PRODUCING SAME

(75) Inventor: Norio Matsumura, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/047,742

(22) Filed: Feb. 2, 2005

(65) Prior Publication Data

US 2005/0170707 A1 Aug. 4, 2005

(30) Foreign Application Priority Data

Feb. 2, 2004 (JP) ..... P2004-025917

(51) Int. Cl.
*H01R 4/02* (2006.01)

(52) U.S. Cl. ..... 439/874

(58) Field of Classification Search ..... 439/874, 439/883, 755, 762, 768, 736, 658, 693; 29/883–884
See application file for complete search history.

(56) References Cited

U.S. PATENT DOCUMENTS 3,126,242 A * 3/1964 Herman ..... 439/682
4,038,743 A * 8/1977 DuRocher et al. ..... 29/869
4,280,748 A 7/1981 McHenney et al.
4,473,268 A * 9/1984 Watanabe ..... 439/483
4,971,567 A * 11/1990 Mizuno et al. ..... 439/98
5,191,710 A 3/1993 Fujimaki et al.
6,413,462 B1 * 7/2002 Zoell et al. ..... 264/263
6,452,101 B1 9/2002 Haramaki et al.
6,632,104 B2 * 10/2003 Quadir ..... 439/587
6,719,595 B1 * 4/2004 Welcker ..... 439/883

FOREIGN PATENT DOCUMENTS

DE 29915396 U1 1/2000
JP 63198275 A 8/1988
JP 11-260238 A 9/1999

* cited by examiner

*Primary Examiner*—Edwin A. León
(74) *Attorney, Agent, or Firm*—Sughrue Mion, PLLC

(57) ABSTRACT

A wire end terminal includes a terminal body portion formed by melting and stamping conductors of a wire W, and a fuse element portion formed between the terminal body portion and the conductors.

6 Claims, 3 Drawing Sheets

WIRE END TERMINAL AND METHOD OF PRODUCING SAME

BACKGROUND OF THE INVENTION

This invention relates to a wire end terminal having a fuse element portion formed integrally therewith, and also relates to a method of producing this wire end terminal.

FIG. 5 shows one conventional wire end terminal of this kind (see, for example, Patent Literature 1). As shown in FIG. 5, this wire end terminal 50 includes a wire press-clamping portion 51 for being press-fastened to a conductor (not shown) of a wire W, a terminal body portion 52 for being fixed by a bolt, and a fuse element portion 53 which is provided between the terminal body portion 52 and the wire press-clamping portion 51, and melts when an electric current of above a predetermined level flows therethrough.

When an excess current flows through the wire W, the fuse element portion 53 of the wire end terminal 50 melts, thereby protecting the wire and others from the excess current.

Patent Literature 1: JP-A-11-260238 (FIG. 1)

In the above related structure, however, the wire W and the wire end terminal 50 are separate from each other, and therefore in the case of producing a wire harness with the wire end terminals, the number of its component parts is large, and therefore there has been encountered a problem that the cost increases. And besides, the wire end terminal 50 is connected to the wire W by press-fastening the wire press-clamping portion 51 to the conductor of the wire W, and therefore a resistance loss develops at the press-fastened portion. As a result, there has been encountered a problem that a voltage drop loss is large, so that the reliability of the connection is lowered.

SUMMARY OF THE INVENTION

Therefore, this invention has been made in order to solve the above problems, and an object of the invention is to provide a wire end terminal as well as a method of producing the same, in which in the case of producing a wire with wire end terminals, the cost can be reduced by reducing the number of component parts, and also a voltage drop loss is small, so that the reliability of the connection is enhanced.

(1) A wire end terminal comprising:
- conductors that constitute a wire;
- a terminal body portion that is formed integrally, homogeneously with the conductors; and
- a fuse element portion that is formed between the terminal body portion and the conductors and has a cross-sectional area smaller than that of the terminal body portion.

(2) A wire end terminal according to (1) further comprising: a cover that covers the fuse element portion.

(3) A wire end terminal according to (2), wherein the cover is made from a transparent resin.

(4) A wire end terminal according to (1), wherein the terminal body portion has a flat plate-shape.

(5) A wire end terminal according to (1), wherein the terminal body portion includes a bolt passage hole.

(6) A method of producing a wire end terminal, the method comprising:
- melting conductors of a wire end to form a flat plate-shaped intermediate formation portion;
- stamping the intermediate formation portion to form a terminal body portion; and
- forming a fusible portion between the terminal body portion and the conductors to form a fuse element portion.

(7) A method of producing a wire end terminal according to (6), wherein in the stamping step, a bolt passage hole is formed to the terminal body portion.

(8) A method of producing a wire end terminal according (6), wherein in the step to form the fusible portion, a cross-sectional area of the fusible portion is adjusted so as to be smaller than that of the terminal body portion.

According to the invention, the wire end terminal is formed by processing the conductors of the wire, and therefore the cost is reduced since the number of the component parts is reduced, and besides a voltage drop loss is small, so that the reliability of the connection is enhanced.

According to the invention, the fuse element portion is reinforced and protected by the cover.

According to the invention, the fuse element portion is reinforced and protected by the transparent cover, and besides it can be confirmed from the exterior whether or not the fuse element portion melts.

DETAIL DESCRIPTION OF PREFERRED EMBODIMENT

One preferred embodiment of the present invention will now be described with reference to the drawings.

Figure 1:
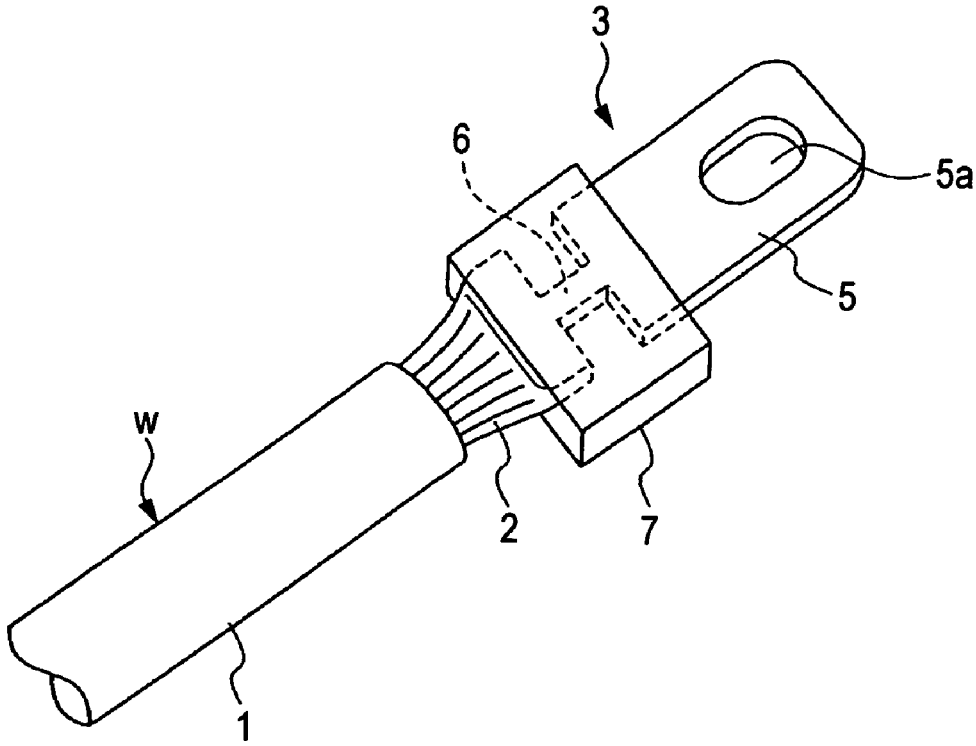
FIG. 1 is a perspective view of one preferred embodiment of an automotive eyelet terminal of the present invention provided at an end portion of a wire.
Figure 2:
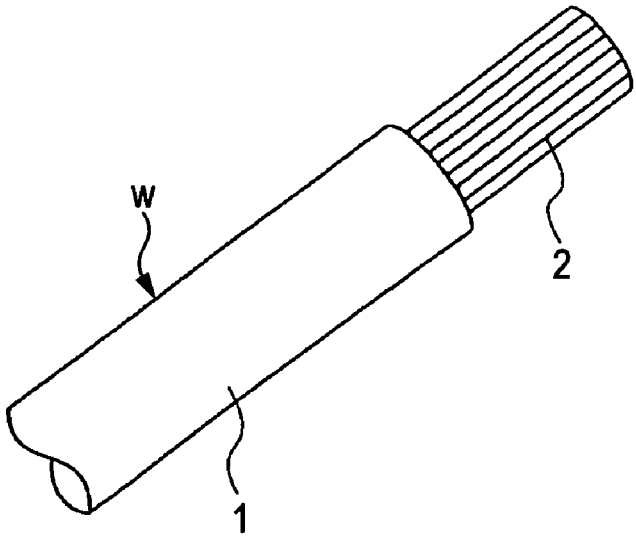
FIG. 2 is a perspective view of the wire of the above embodiment having an insulating sheath removed from the end portion thereof.
Figure 3:
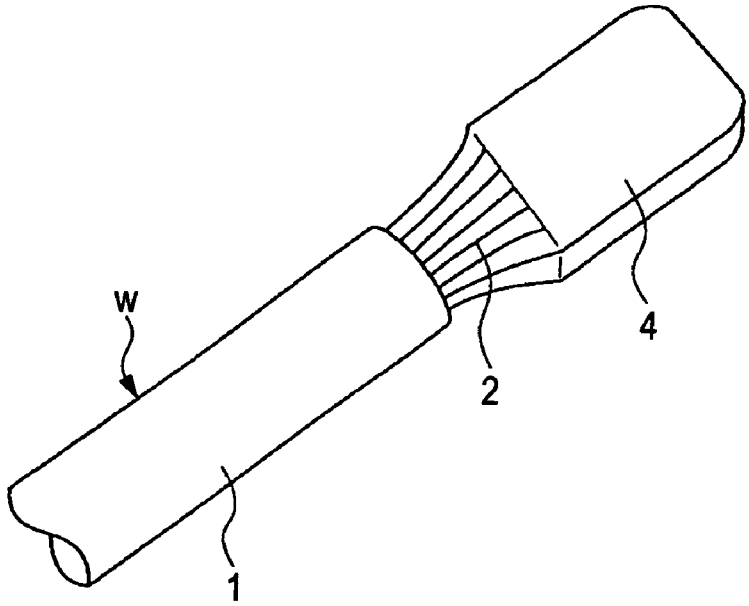
FIG. 3 is a perspective view of an intermediate formation portion of the above embodiment formed by melting conductors of the wire.
Figure 4:
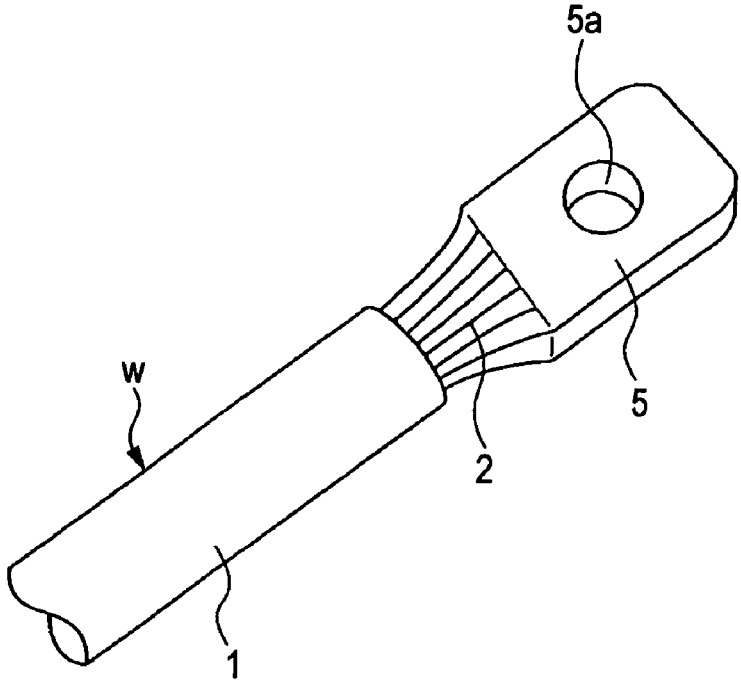
FIG. 4 is a perspective view of a terminal body portion of the above embodiment formed by stamping the intermediate formation portion.
Figure 5:
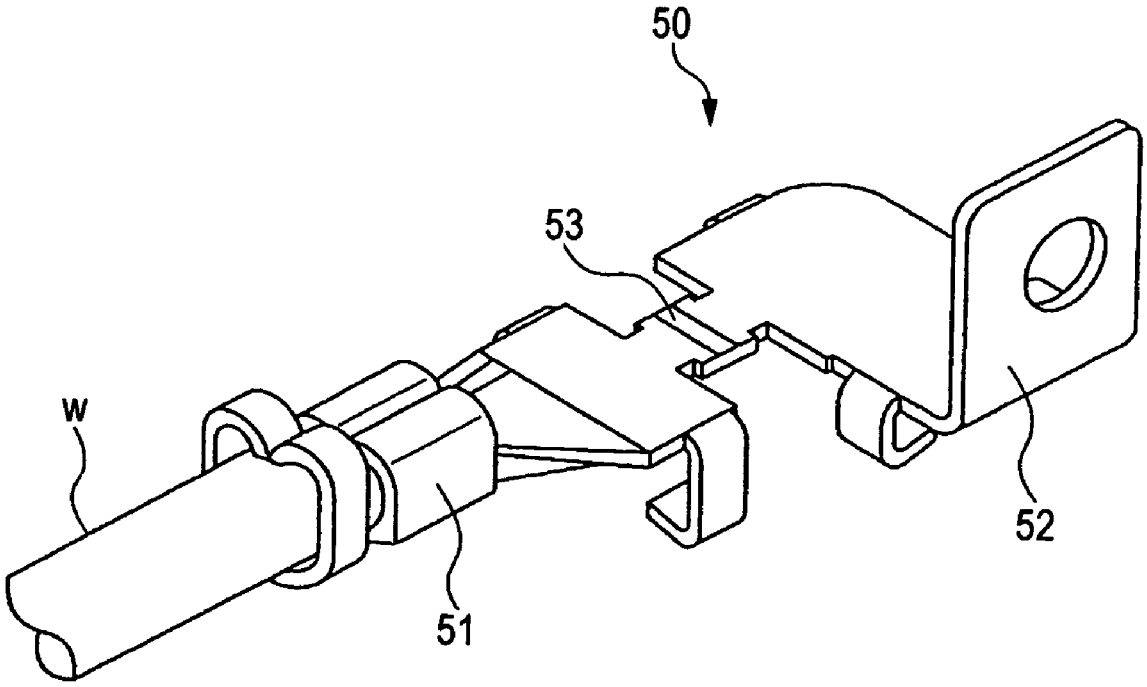
FIG. 5 is a perspective view of a related wire end terminal.

FIGS. 1 to 4 show one preferred embodiment of the invention, and FIG. 1 is a perspective view showing an automotive eyelet terminal provided at an end portion of a wire, FIG. 2 is a perspective view of the wire having an insulating sheath removed from the end portion thereof, FIG. 3 is a perspective view of an intermediate formation portion formed by melting conductors of the wire, and FIG. 4 is a perspective view of a terminal body portion formed by stamping the intermediate formation portion.

As shown in FIG. 1, the conductors 2 is exposed at the end portion of the wire W by removing the insulating sheath 1 therefrom, and the automotive eyelet terminal (LA terminal) 3 is integrally connected to this conductors 2 and formed homogeneously with this conductors 2. This automotive eyelet terminal 3 includes the terminal body portion 5 formed by melting stamping the conductors 2 of the wire W, a fuse element portion 6 formed between the terminal body portion 5 and the conductors, and a resin-made cover 7 covering the entire outer periphery of the fuse element portion 6. The terminal body portion 5 has a flat plate-shaped, and has a bolt passage hole 5*a* formed through its central portion. The cover 7 is made of a transparent resin so that the fuse element portion 6 within the cover 7 can be viewed through this cover 7.

Next, a method of producing the automotive eyelet terminal 3 will be described. There is prepared a long wire W having conductors 2 and a resin-made insulating sheath 1 covering the outer periphery of the conductors 2. The automotive eyelet terminal 3 is produced, using this wire W as a material.

First, the insulating sheath 1 is removed from an end portion of the wire W, thereby exposing the conductors 2 at the end portion of the wire W as shown in FIG. 2.

Then, the exposed conductors 2 are formed into the flat plate-shaped intermediate formation portion 4. To form the intermediate formation portion 4, the exposed conductors 2 are melted to be integrated, and after curing, the cured integrated conductors are stamped in the shape as shown in FIG. 3.

Instead of the above method of forming the intermediate formation portion 4, the intermediate formation portion 4 can be formed by melting the exposed conductors in a state that the conductors are arranged in a mold to shape the melted conductors into the flat plate-shape. With this method, the step of stamping can be omitted.

Then, the terminal body portion 5 is formed with the bolt passage hole 5*a* by stamping the intermediate formation portion 4 as shown in FIG. 4.

Then, a fusible portion is formed between the terminal body portion 5 and the conductors 2. The fuse element portion is a part of the terminal body portion, and a cross-sectional area thereof is adjusted so as to be smaller than that of the terminal body portion. Therefore, the fuse element portion serves as a fuse that melts when an excess current flows through it. Finally, by a resin inner-molding method or the like, the cover 7 is formed to cover the outer periphery of the fuse element portion 6, thus completing the terminal producing process.

When an excess current flows through the wire W, the fuse element portion 6 of the automotive eyelet terminal 3 of this construction melts, thereby protecting the wire and others from the excess current.

As described above, the automotive eyelet terminal 3 is formed integrally, homogeneously with the conductors 2 of the wire W, and therefore the cost is reduced since the number of the component parts is reduced, and besides a voltage drop loss is small, so that the reliability of the connection is enhanced.

Furthermore, the outer periphery of the fuse element portion 6 is covered with the transparent cover 7, and therefore the fuse element portion 6 is reinforced and protected by this cover 7, and besides it can be confirmed from the exterior whether or not the fuse element portion 6 melts.

In the above embodiment, although the wire end terminal is the automotive eyelet terminal 3, the invention can be applied to any other suitable terminal than such an automotive eyelet terminal.

What is claimed is:

1. A wire end terminal comprising:

a wire constituted by a plurality of conductors;

a terminal body portion in which the plurality of conductors are formed integrally and homogeneously by melting an end portion of the wire such that the plurality of conductors at the end portion are formed into a flat plate-shape; and a fuse element portion that is formed between the terminal body portion and the conductors such that the fuse element portion melts when an excess current flows through the wire, thereby protecting at least the wire from the excess current, the fuse element portion having a cross-sectional area smaller than that of the terminal body portion and the fuse element portion being integrally and homogenously formed between the terminal body and the conductors.

2. A wire end terminal according to claim 1, wherein the terminal body portion has a flat plate-shape.

3. A wire end terminal according to claim 1, wherein the terminal body portion includes a bolt passage hole.

4. The wire end terminal of claim 1, wherein the fuse element portion has a cross-sectional area that is smaller than a cross-sectional area of the conductors immediately adjacent the fuse element portion.

5. A wire end terminal according to claim 1 further comprising:

a cover that covers the fuse element portion.

6. A wire end terminal according to claim 5, wherein the cover is made from a transparent resin.

* * * * *